US006883988B1

(12) United States Patent
Brown et al.

(10) Patent No.: US 6,883,988 B1
(45) Date of Patent: Apr. 26, 2005

(54) VERTICAL BLIND CLEANING TOOL

(76) Inventors: Beatrice Brown, 2206 Jefferson St., Baltimore, MD (US) 21205; Valeria D. Boyd, 2206 Jefferson St., Baltimore, MD (US) 21205

( * ) Notice: Subject to any disclaimer, the term of this patent is extended or adjusted under 35 U.S.C. 154(b) by 0 days.

(21) Appl. No.: 10/877,020

(22) Filed: Jun. 28, 2004

(51) Int. Cl.[7] ..... A46B 15/00
(52) U.S. Cl. ..... 401/10; 401/9; 15/220.3
(58) Field of Search ..... 401/9–11; 15/220.3, 15/394

(56) References Cited

U.S. PATENT DOCUMENTS 2,488,334 A * 11/1949 Schryner ..... 401/10
2,624,899 A * 1/1953 Smith ..... 401/6
2,788,637 A * 4/1957 Greenberg ..... 401/10
2,789,307 A * 4/1957 Sussman et al. ..... 15/394
2,804,640 A * 9/1957 Zaidan ..... 15/394
3,045,275 A * 7/1962 Delacretaz ..... 15/369
4,718,141 A * 1/1988 Kuehnl ..... 15/394

* cited by examiner

*Primary Examiner*—Gregory L. Huson
*Assistant Examiner*—Huyen Le

(57) ABSTRACT

A vertical blind cleaning tool includes an elongate handle having a first end and a second end. A cavity is positioned in the handle. An outlet extends through the first end and into the cavity. A prong attachment is removably attached to the first end and includes a tubular member with a prong portion and a coupling portion. The coupling portion has a free end removably insertable into the first end of the handle. A receiving conduit extends through the prong attachment and may be fluidly coupled to the outlet of the handle. A plurality of openings extends through an inside surface and into the receiving conduit. An adsorptive membrane has a shape and size generally equal to the inside surface. The membrane is frictionally coupled to the prong portion. Fluid may flow from the cavity to the membrane and the membrane moved along either side of a vertical blind.

7 Claims, 4 Drawing Sheets

VERTICAL BLIND CLEANING TOOL

BACKGROUND OF THE INVENTION

1. Field of the Invention

The present invention relates to devices for cleaning vertical blinds and more particularly pertains to a new device for cleaning vertical blinds for allowing a user to clean both sides of a vertical slat simultaneously from top to bottom with one or two downward motions.

2. Description of the Prior Art

The use of devices for cleaning vertical blinds is known in the prior art. U.S. Pat. No. 1,297,567 describes an automobile washer for cleaning the wheels of an automobile. Another type of device for cleaning vertical blinds is U.S. Pat. No. 2,622,256 describing a combined cleaning and drying implement for vertical blinds. U.S. Pat. No. 2,663,046 describes a device for cleaning venetian blinds that can attach to a vacuum cleaner. U.S. Pat. No. 4,940,349 describes a golf club cleaner for cleaning the head of a golf club.

While these devices fulfill their respective, particular objectives and requirements, the need remains for a device that can simultaneously clean both sides of a vertical blind.

SUMMARY OF THE INVENTION

The present invention meets the needs presented above by utilizing attachments to allow a user to perform various cleaning tasks with one device.

Another object of the present invention is to provide a new device for cleaning vertical blinds that is specially designed to minimize drips and messes usually associated with cleaning vertical blinds.

Yet another object of the present invention is to provide a new device for cleaning vertical blinds that provides users with an efficient way to simultaneously clean the front and back surfaces of vertical blinds with a detergent solution.

To this end, the present invention generally comprises an elongate handle having a first end, a second end and a peripheral wall extending between the first and second ends. A cavity is positioned in the handle. An outlet extends through the first end and into the cavity. A prong attachment is removably attached to the first end. The prong attachment includes a tubular member having a prong portion and a coupling portion. The prong portion includes a pair of arms. The prong portion has an inside surface. The coupling portion has a free end removably insertable into the first end of the handle. A receiving conduit extends through the prong attachment and has an inlet extending outward through the free end such that the inlet may be fluidly coupled to the outlet of the handle. A plurality of openings extend through the inside surface and into the receiving conduit. A slot extends into and along the inside surface of the prong portion. Each of the openings extends into the slot. An adsorptive membrane has a shape and size generally equal to the inside surface. The membrane has an outer surface having a ridge thereon. The ridge is removably positionable in the slot such that the membrane is frictionally coupled to the prong portion. Fluid may flow from the cavity to the membrane and the membrane moved along either side of the vertical blind.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
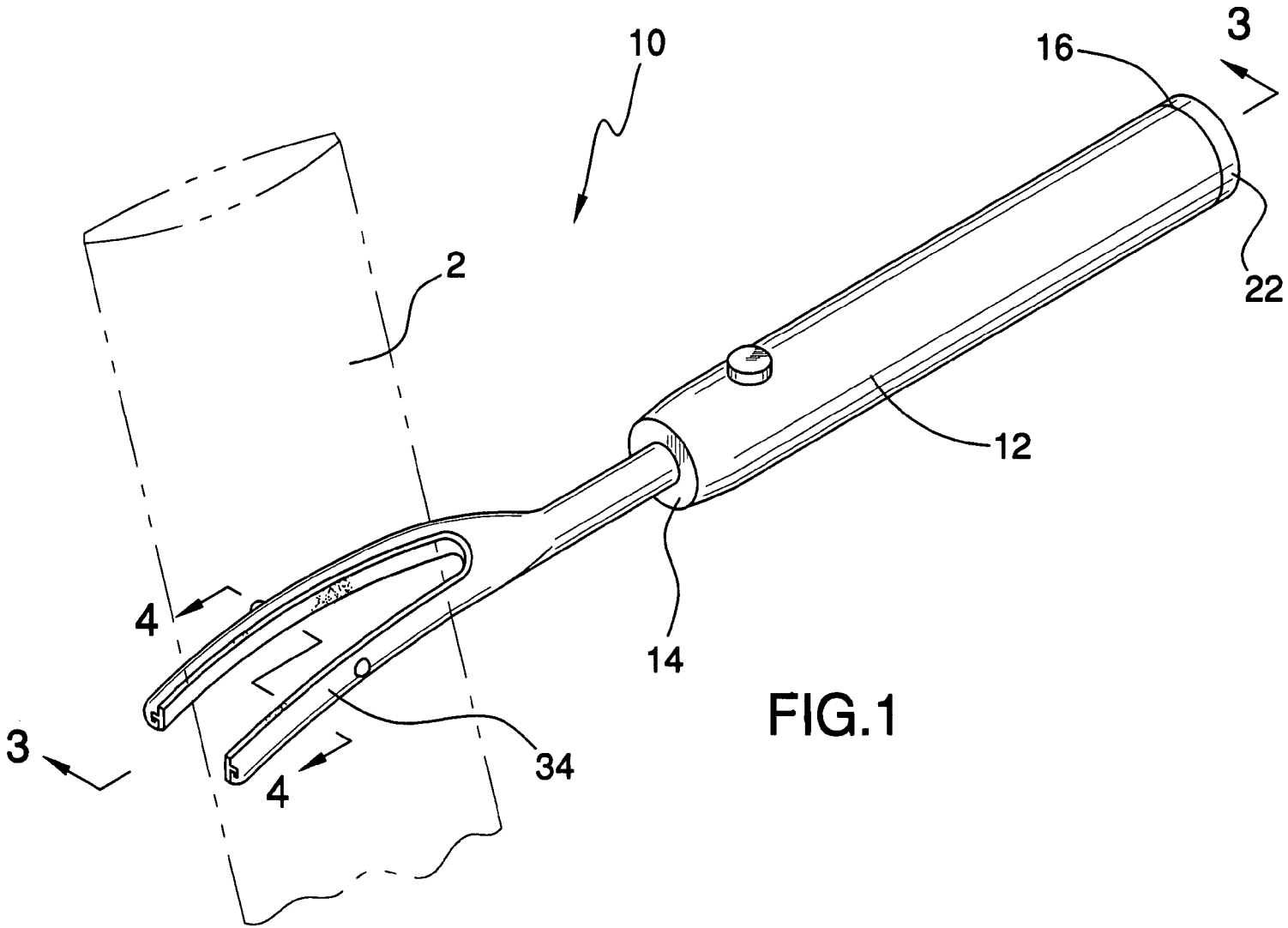
FIG. 1 is a perspective view of a vertical blind cleaning tool according to the present invention.
Figure 2:
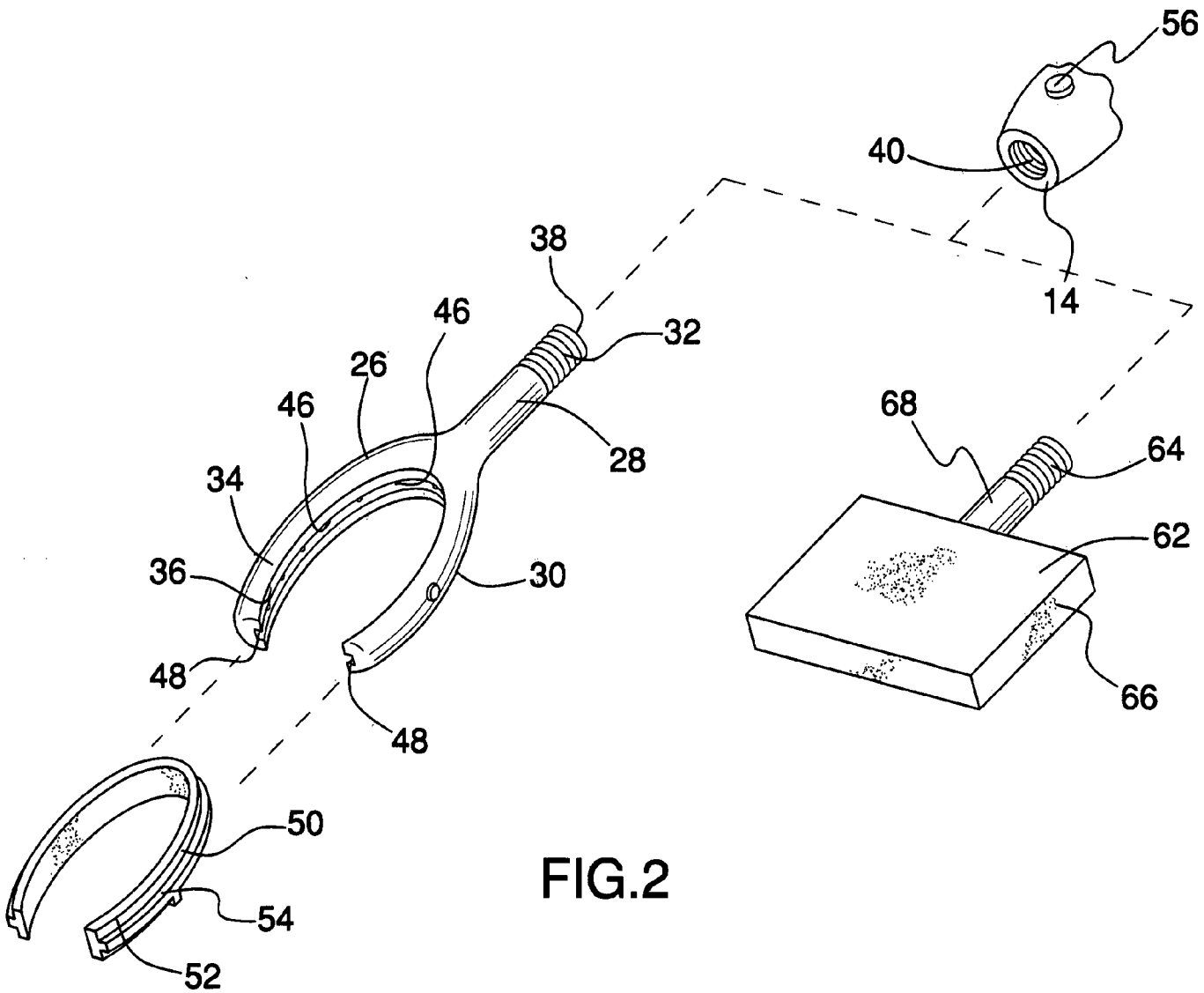
FIG. 2 is a perspective view of the present invention.
Figure 3:
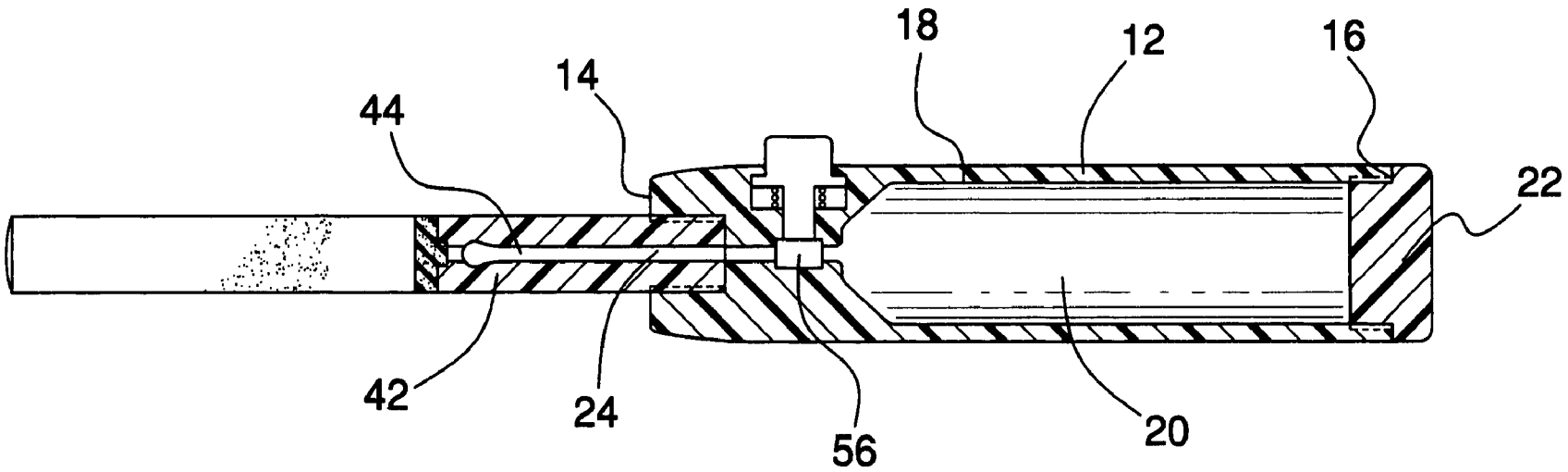
FIG. 3 is a cross-sectional view taken along the line 3—3 of FIG. 1 of the present invention.
Figure 4:
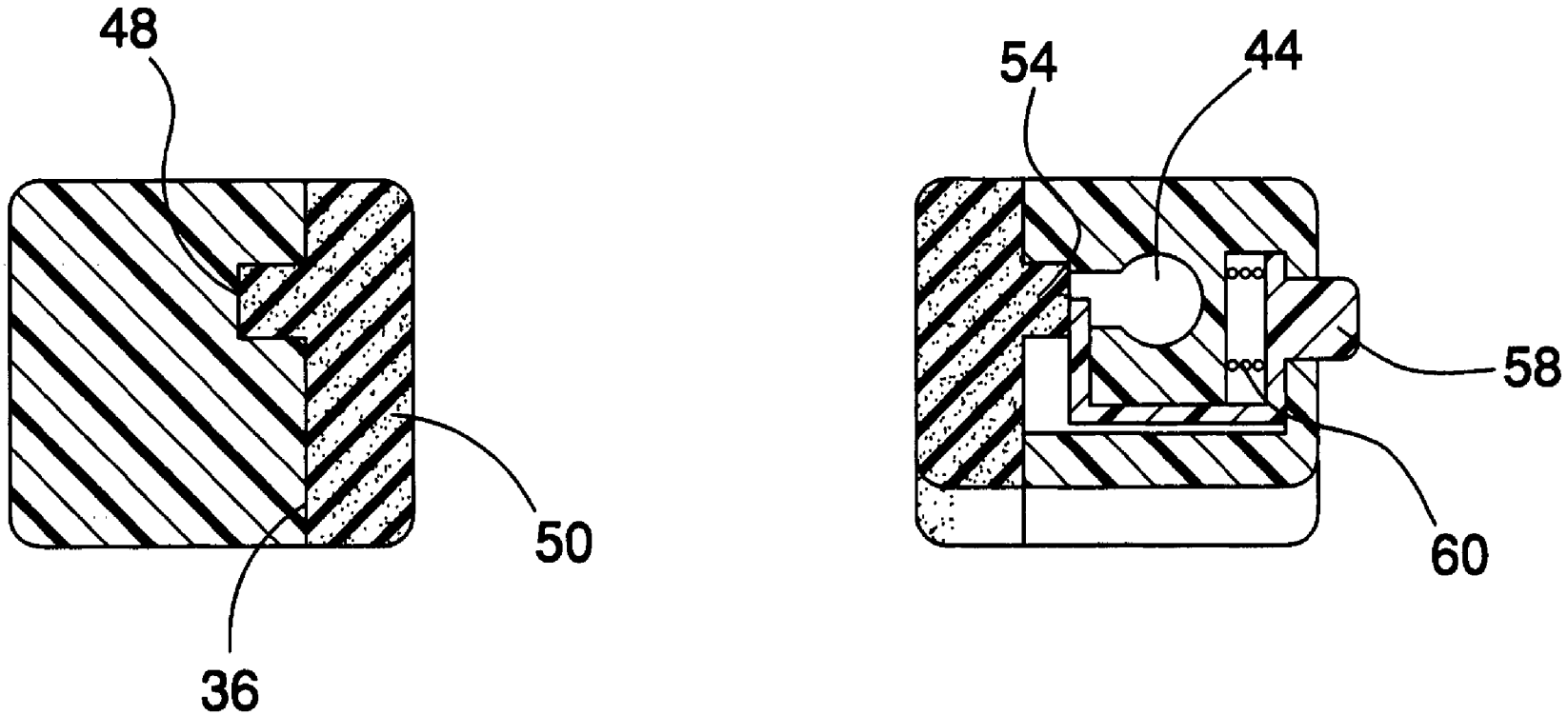
FIG. 4 is a cross-sectional view taken along the line 4—4 of FIG. 1 of the present invention.

With reference now to the drawings, and in particular to FIGS. 1 through 4 thereof, a new device for cleaning vertical blinds embodying the principles and concepts of the present invention and generally designated by the reference numeral 10 will be described.

As best illustrated in FIGS. 1 through 4, vertical blind cleaning tool 10 generally comprises an elongate handle 12 having a first end 14, a second end 16 and a peripheral wall 18 extending between the first 14 and second 16 ends. A cavity 20 is positioned in the handle 12. The second end 16 comprises a cap 22 which threadably coupled to the peripheral wall 18 for selectively accessing the cavity 20. An outlet 24 extends through the first end 14 and into the cavity 20. The outlet 24 allows cleaning fluid, which is placed in the cavity 20, to escape the handle 12.

A prong attachment 26 is removably attached to the first end 14 of the handle 12. The prong attachment 26 includes a tubular member 28 having a prong portion 30 and a coupling portion 32. The prong portion 30 includes a pair of arms 34. The prong portion 30 has an inside surface 36 wherein the inside surface 36 of the arms 34 face each other. The coupling portion 32 has a free end 38 that is removably insertable into the first end 14 of the handle 12. Ideally, the free end 38 is inserted into a well 40 in the first end 14 of the handle 12 and is threadably attached thereto. A receiving conduit 42 extends through the prong attachment 26 and has an inlet 44 extending outward through the free end 38 such that the inlet 44 is fluidly coupled to the outlet 24 of the handle 12 when the prong attachment 26 is coupled to the handle 12. A plurality of openings 46 extend through the inside surface 36 and into the receiving conduit 42. A slot 48 extends into and along the inside surface 36 of the prong portion 30. The openings 46 extend into the slot 48.

An adsorptive membrane 50 has a shape and size generally equal to the inside surface 36. The membrane 50 has an outer surface 52 having a ridge 54 thereon, which ridge 54 is removably positionable in the slot 48 such that the membrane 50 is frictionally coupled to the prong portion 30. Ideally, the adsorptive membrane 50 comprises a resiliently elastic sponge material.

A pump 56 for forcing liquid from the cavity 20 into the outlet 24 is positioned in the handle 12 and is fluidly coupled to the outlet 24. The pump 56 extends through the peripheral wall 18 so it can be actuated. The pump 56 is a conventional type pump.

A plurality of release buttons 58 is mounted in the pronged portion 30. Each of the release buttons 58 is movably mounted and extending into the pronged portion 30 and abuts the membrane 50 when the membrane 50 is frictionally coupled to the prong portion 30. The release buttons 58 are biased outward away from the membrane 50 by a spring 60. The release buttons 58 are used for selectively moving the ridge 54 outward of the slot 48. In this manner the membrane 50 can be replaced for cleaning or when it wears out.

Additionally, a panel shaped attachment 62 may also be used having a coupler 64 and a sponge 66 attached to the coupler 64. The coupler 64 would also have an inlet conduit 68 for supplying fluid to the sponge 66.

In use, fluid may be positioned in cavity 20 and sent through the prong attachment 26 and into the membrane 50. The membrane 50 absorbs the fluid and the membrane 50 is moved along vertical blind panels 2 to clean them. The fluid aids in the cleaning of the panels 2 while the arms are positioned on either side of the panels. This allows both sides of the panels 2 to be cleaned at the same time. The panel shaped attachment 62 may be used for cleaning the panels 2 and other areas.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tool for cleaning vertical blinds, said tool comprising:

an elongate handle having a first end, a second end and a peripheral wall extending between said first and second ends, a cavity being positioned in said handle, an outlet extending through said first end and into said cavity;

a prong attachment being removably attached to said first end, said prong attachment including a tubular member having a prong portion and a coupling portion, said prong portion including a pair of arms, said prong portion having an inside surface wherein the inside surface of said arms face each other, said coupling portion having a free end being removably insertable into said first end of said handle, a receiving conduit extending through said prong attachment and having an inlet extending outward through said free end such that said inlet may be fluidly coupled to said outlet of said handle, a plurality of openings extending through said inside surface and into said receiving conduit, a slot extending into and along said inside surface of said prong portion, each of said openings extending into said slot;

an adsorptive membrane having a shape and size generally equal to said inside surface, said membrane having an outer surface having a ridge thereon, said ridge being removably positionable in said slot such that said membrane is frictionally coupled to said prong portion; and wherein fluid may flow from said cavity to said membrane and said membrane moved along either side of the vertical blind.

2. The tool for cleaning vertical blinds as in claim 1, wherein said second end comprises a cap being selectively attached to said peripheral wall for accessing said cavity.

3. The tool for cleaning vertical blinds as in claim 1, wherein said adsorptive member comprises a resiliently elastic sponge material.

4. The tool for cleaning vertical blinds as in claim 1, further including a pump for forcing liquid from said cavity into said outlet being positioned in said handle and being fluidly coupled to said outlet.

5. The tool for cleaning vertical blinds as in claim 4, further including a plurality of release buttons being mounted in said pronged portion, each of said release buttons being movably mounted and extending into said pronged portion and abutting said membrane when said membrane is frictionally coupled to said prong portion, wherein said release buttons may selectively move said ridge outward of said slot.

6. The tool for cleaning vertical blinds as in claim 1, further including a plurality of release buttons being mounted in said pronged portion, each of said release buttons being movably mounted and extending into said pronged portion and abutting said membrane when said membrane is frictionally coupled to said prong portion, wherein said release buttons may selectively move said ridge outward of said slot.

7. A tool for cleaning vertical blinds, said tool comprising:

an elongate handle having a first end, a second end and a peripheral wall extending between said first and second ends, a cavity being positioned in said handle, said second end comprising a cap being selectively attached to said peripheral wall for accessing said cavity, an outlet extending through said first end and into said cavity;

a prong attachment being removably attached to said first end, said prong attachment including a tubular member having a prong portion and a coupling portion, said prong portion including a pair of arms, said prong portion having an inside surface wherein the inside surface of said arms face each other, said coupling portion having a free end being removably insertable into said first end of said handle, a receiving conduit extending through said prong attachment and having an inlet extending outward through said free end such that said inlet is fluidly coupled to said outlet of said handle, a plurality of openings extending through said inside surface and into said receiving conduit, a slot extending into and along said inside surface of said prong portion, said openings extending into said slot;

an adsorptive membrane having a shape and size generally equal to said inside surface, said membrane having an outer surface having a ridge thereon, said ridge being removably positionable in said slot such that said membrane is frictionally coupled to said prong portion, said adsorptive member comprising a resiliently elastic sponge material;

a pump for forcing liquid from said cavity into said outlet being positioned in said handle and being fluidly coupled to said outlet;

a plurality of release buttons being mounted in said pronged portion, each of said release buttons being movably mounted and extending into said pronged portion and abutting said membrane when said membrane is frictionally coupled to said prong portion, wherein said release buttons may selectively move said ridge outward of said slot; and wherein fluid may be positioned in cavity and sent through said prong attachment and into said membrane, wherein said membrane may be moved along either side of the vertical blind for cleaning such.

* * * * *